United States Patent [19]

Hooper

[11] 4,138,875

[45] Feb. 13, 1979

[54] SHEET METAL BENDING MACHINE

[75] Inventor: Peter E. Hooper, Burlington, Canada

[73] Assignee: Arnold Davis, Toronto, Canada

[21] Appl. No.: 855,174

[22] Filed: Nov. 28, 1977

[51] Int. Cl.[2] ..... B21D 9/14

[52] U.S. Cl. ..... 72/307; 72/312; 72/421

[58] Field of Search ..... 72/307, 312, 315, 414, 72/379, 385, 421, 422

[56] References Cited

U.S. PATENT DOCUMENTS

| | | | |
|---|---|---|---|
| 2,330,572 | 9/1943 | Frey et al. | 72/414 |
| 3,664,170 | 5/1972 | Davis | 72/307 |
| 3,800,583 | 4/1974 | Miller | 72/422 |
| 3,805,582 | 4/1974 | Logan | 72/422 |
| 3,874,214 | 4/1975 | Racicot | 72/307 |

*Primary Examiner*—Michael J. Keenan

*Attorney, Agent, or Firm*—Fetherstonhaugh & Co.

[57] ABSTRACT

A bending machine for bending longitudinally elongated channel-shaped sheet metal members according to the present invention consists of a frame and a die set including a female die assembly and a male die assembly and drive means for driving the die set to and fro between an open and closed position. The female die assembly consists of two members, one of which is held stationary relative to the frame and the other of which is movable relative to the first for movement towards and away from the male die element. The first member of the female die assembly serves to clamp the channel-shaped member with respect to the male die element and the second member of the female die assembly serves to form corrugations in the elongated channel-shaped members.

6 Claims, 7 Drawing Figures

SHEET METAL BENDING MACHINE

FIELD OF INVENTION

This invention relates to a bending machine for bending longitudinally elongated channel-shaped members to an arcuate curvature.

PRIOR ART

Channel-shaped sheet metal members have been used in the fabrication of arcuate-shaped metal buildings for some considerable time. Difficulty has been experienced in forming the channel-shaped members to the required arcuate configuration without substantially reducing the structural strength of the sheet metal members. In the bending operations presently used, local areas of the sheet metal members are stretched or buckled with the resulting decrease in structural strength.

The bending machine of the present invention serves to form corrugations in the bottom and side walls of the channel-shaped member to effect a reduction in length thereof and thereby bend the channel-shaped member to an arcuate configuration. The machine is set up to form the corrugations in a manner such that there is little or no stretching or buckling of the sheet metal in the area of the corrugations.

The bending machine may also have a feeding mechanism which serves to release the sheet metal member from the bending dies after each bending stroke to facilitate the movement of the sheet metal member through the bite of the dies.

SUMMARY OF INVENTION

According to one aspect of the present invention, a bending machine for bending longitudinally elongated channel-shaped sheet metal members comprises a frame, a die set mounted in said frame comprising; a female die assembly comprising, a first member having a first die face formed to provide a bottom face and side faces arranged in a female channel configuration to provide exterior support for a channel-shaped sheet metal member, a passage formed in said first member and opening at said die face through said bottom and side faces; and a second member mounted for movement relative to said first member and having a bending edge movable between an extended position in which it projects outwardly from said first die face through said passage and a withdrawn position in which it does not project beyond said first die face, a male die element having a second die face formed with bottom and side faces arranged opposite said bottom and side faces respectively of said female die, said male die element being mounted for movement towards and away from said first member of said female die assembly between an open position to permit movement of a sheet metal member therebetween and a closed position to clamp a channel-shaped sheet member therebetween about the periphery of said passage, drive means for driving the male die element relative to the first member of the female die assembly to clamp a sheet metal member therebetween about the periphery of said passage and thereafter to drive the second member from said withdrawn position to said extended position to bend the bottom and side walls of the sheet metal to form a transversely extending corrugation in the sheet metal member and thereby shorten the bottom wall of the sheet metal member in relation to the outer ends of its side walls and thereby bend the sheet metal member in the direction of its longitudinal extent.

According to a further aspect of the present invention, there is provided in a bending machine of the type described above endless conveyor means extending rearwardly and forwardly from the first member of the female die through recesses in the die face of the first member, the conveyor means being drawn to a taut configuration in a plane spaced outwardly from the first die face for ejecting the sheet metal members from the female die prior to advancement of the sheet metal members through the die, the conveyor means having a sufficient length when relaxed to permit it to be lowered into the recess means provided in the first die when the die set is in a closed position.

PREFERRED EMBODIMENT

The invention will be more clearly understood after reference to the following detailed specification read in conjunction with the drawings wherein, FIG. 1 is a pictorial view of a machine according to an embodiment of the present invention;

Figure 2:
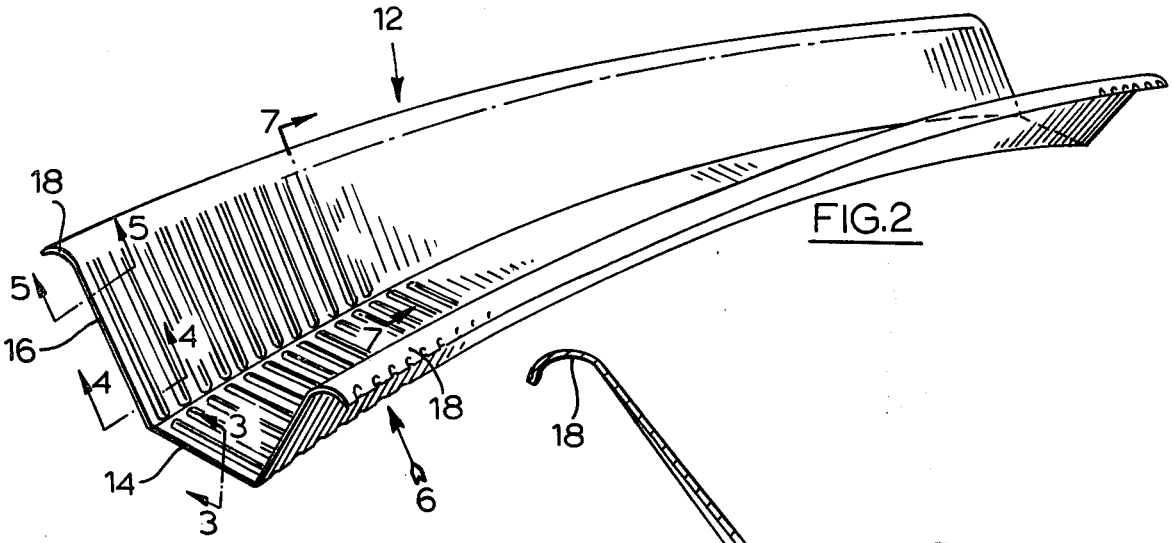
FIG. 2 is a pictorial view of a sheet metal member after it is bent by the machine of the present invention.
Figure 7:
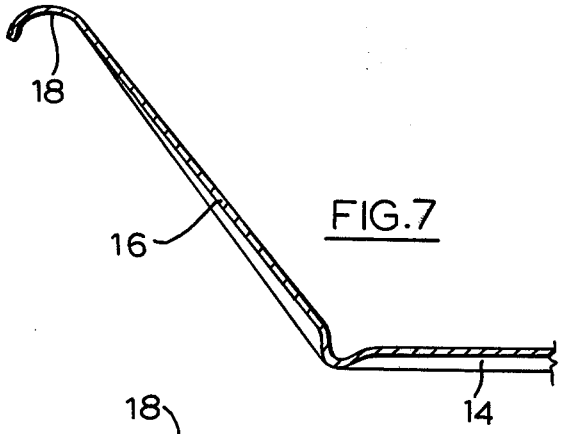
Figure 3:
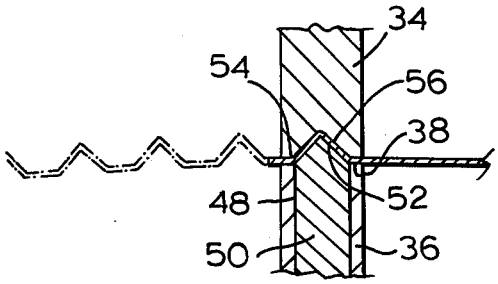
FIG. 3 is a sectional view in the direction of the arrows 3—3 of FIG. 2 with the die members located in a position to form the required corrugation.
Figure 6:
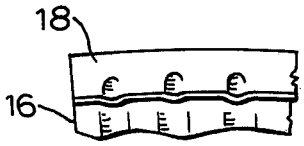
Figure 4:
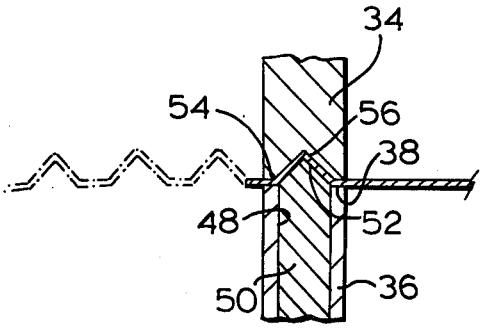
Figure 5:
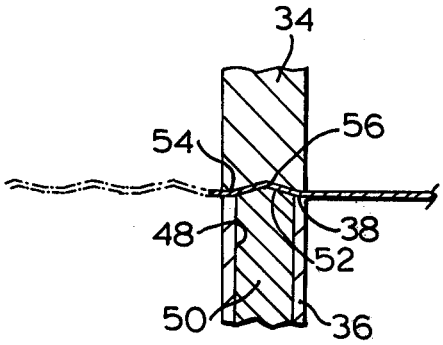

FIGS. 4 and 5 are sectional views similar to FIG. 3 taken along line 4—4 and line 5—5 of FIG. 2, respectively, showing the contour of the corrugations;

FIG. 6 is a view of an upper edge of a sheet metal member in the direction of the arrow 6 of FIG. 2; and FIG. 7 is a sectional view in the direction of the arrow 7—7 of FIG. 2.

With reference to the drawings, the reference numeral 10 refers generally to a bending machine constructed in accordance with an embodiment of the present invention.

Figure 1:
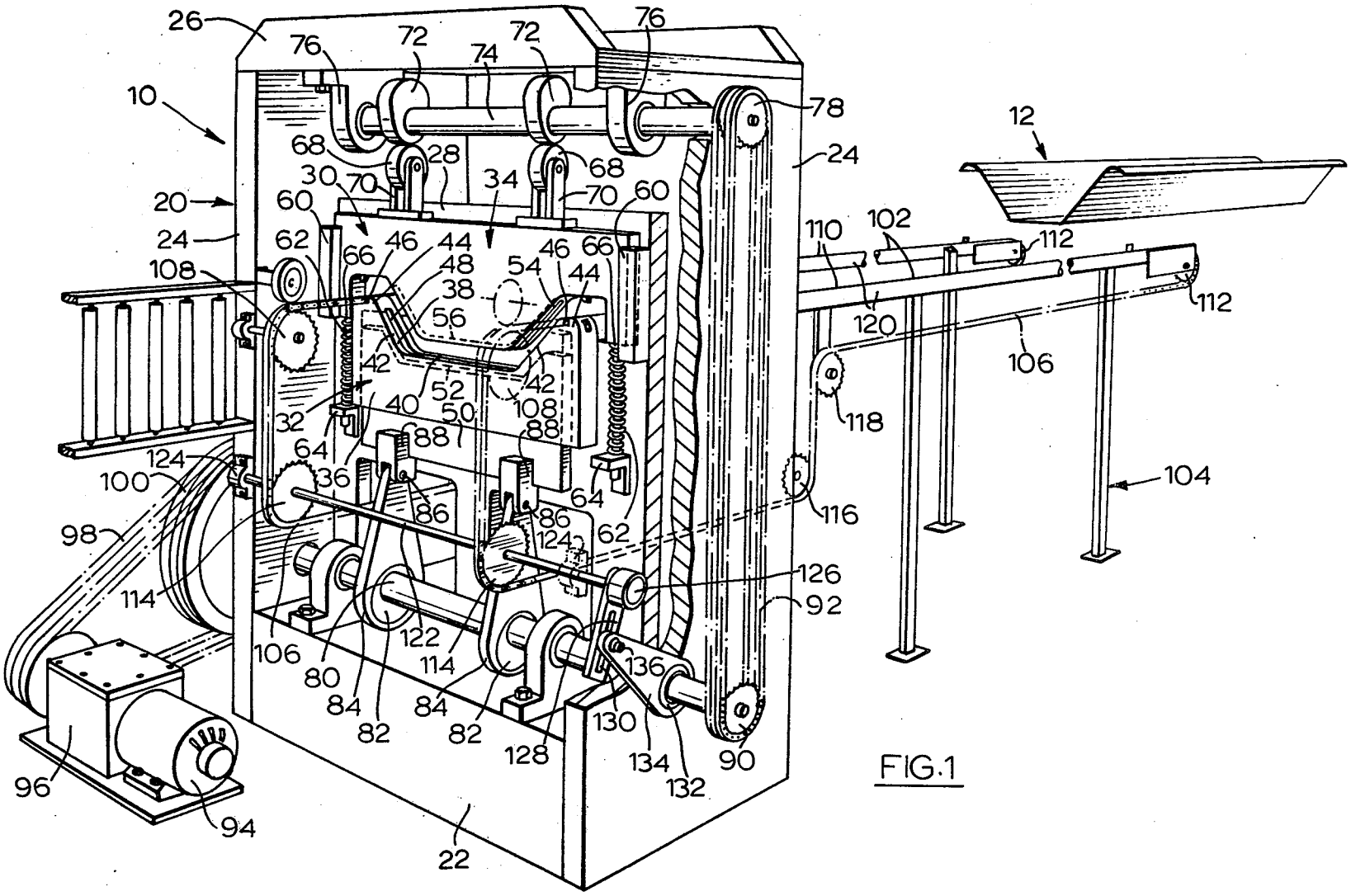

The bending machine 10 is used to bend a longitudinally elongated channel-shaped sheet metal structural member 12 (FIGS. 1 & 2), hereinafter referred to as channel-shaped member 12. The channel-shaped member 12 is formed from sheet metal and has a bottom wall 14 and a pair of oppositely disposed side walls 16, each of which has a lip 18 at the upper end thereof. In use, the bending machine 10 serves to impart a longitudinal curvature to the channel-shaped member 12 by forming a plurality of corrugations in the bottom wall 14 and in side walls 16. The depth of corrugation in the side walls 16 decreases in a direction towards the lip 18 with the result that there is a progressive shortening of the length of the channel-shaped member in a direction away from the lips 18.

The bending machine 10 has a frame, generally identified by the reference numeral 20, which consists of a base 22, a pair of oppositely disposed side walls 24, a top wall member 26 and a face plate 28 which extends between side walls 24.

A die set 30 is mounted in the frame 10 and consists of a female die assembly 32 and a male die element 34. The female die assembly 32 consists of a first member 36 which is mounted in a fixed position with respect to the face plate 28. The first member 36 has a first die face 38 formed to provide a bottom face 40 and a pair of oppositely disposed side faces 42. The side faces 42 each include a shoulder portion 44 formed with recesses 46. The first die face 38 serves to support the exterior surface of the channel-shaped member 12 during the bending operation. A passage 48 extends longitudinally through the body of the first member 36 and opens outwardly therefrom centrally of the length of the first die face 38 at the bottom face 40 and side faces 42. A second member 50 is slidably mounted in the passage 48 for movement relative to the first member 36. The second member 50 has a bending edge 52 at the upper end thereof which is adapted to project outwardly from the first die face through the passage 48 and to be withdrawn inwardly of the passage 48 so that it does not project beyond the first die face.

The male die element 34 has a second die face 54 formed with bottom and side faces arranged opposite the bottom and side faces respectively of the female die assembly. The second die face 54 has a corrugation recess 56 extending along the bottom and side faces thereof in a configuration corresponding to the required contour of the corrugations to be formed in the channel-shaped member. Opposite side edges of the male die 30 are mounted in guides 60. The male die element 34 is normally urged to its raised position by coil springs 62 which have one end resting on a bracket 64 which is secured with respect to the frame 20 and their opposite end bearing against the shoulder 66 at opposite sides of the die. A pair of cam follower rollers 68 are mounted in brackets 70 which project upwardly from the upper edge of the mail die element. Cams 72 are mounted on shaft 74 which is journalled in support brackets 76 which depend from the top wall member 26 of the frame. The shaft 74 projects outwardly from one side of the brackets 76 and has a sprocket 78 mounted thereon by means of which the shaft 74 and cams 72 are rotatably driven to drive the male die member downwardly with springs 62 serving to raise the male die element.

The drive mechanism for driving the second member 50 of the female die assembly comprises a main drive shaft 80 which has eccentric collars 82 mounted for rotation therewith. A pair of arms 84 are mounted one on each eccentric collar 82 and have their upper ends pivotally connected by pivot pins 86 to brackets 88 which are secured to the lower end of the second member 50 of the female die. When the main drive shaft 80 is rotatably driven, the eccentric collars 82 rotate with the shaft relative to the arms 84 and cause the arms 84 to reciprocate vertically to move the second die element 50 between its raised and lowered positions with respect to the first die member 32. A sprocket 90 is located at one end of the main drive shaft 94 and is connected to the sprocket 78 by a drive chain 92 so that the rotation of the shaft 74 and shaft 80 may be synchronized.

The main drive shaft 80 is driven by a motor 94 through reduction gear 96, drive belt 98 and fly wheel 100.

The feeding mechanism for feeding elongated channel-shaped sheet metal members through the die set consists of a pair of conveyors, generally identified by the reference numeral 102, arranged in a spaced parallel relationship one on either side of the first die member 32. The conveyors 102 each have a support frame, generally identified by the reference numeral 104, and consist of a chain 106 which have a feeding run 110 extending over guide pulleys 108 located forwardly of the die set and 112 located rearwardly of the die set. The return run of the chain 106 extends over pulleys 114, 116 and 118. The frame 104 includes support rails 120 which underlie and support the feeding run of the chain to a point adjacent the die set. The pulleys 108 and 112 are located at a height so that when the feeding run 110 of the chain is taut, the chains will rise out of the recesses 46 in the female die in which they are located when relaxed, to eject the channel-shaped sheet metal member from the female die and to raise it above the die face to facilitate forward movement thereof between the dies. The forward movement is achieved by a ratchet mechanism driven from the main drive shaft 80. The pulleys 114 are mounted on shaft 122 which is journalled in bearings 124 carried by the side wall members 24 of the frame. A ratchet mechanism 126 is mounted at one end of the shaft 122 and has a lever arm 128 projecting outwardly therefrom. The lever arm 128 has an elongated slot 130 extending longitudinally thereof. An eccentric collar 132 is mounted on and keyed to main drive shaft 80 for rotation therewith. An arm 134 is mounted on the collar 132 and has its outer end adjustably secured to the lever 128 by mounting screw 136 which may be located at any point along the length of the slot 130 to adjust the length of stroke of the arm 128 and thereby adjust the length of stroke of the feeding mechanism.

From the foregoing description of the bending machine of the preferred embodiment, it will be apparent that the movement of the various die elements and feeding mechanism is achieved by the use of a series of simple mechanical mechanisms which may be adjusted and repaired by mechanics having only minimal knowledge of mechanical devices. The mechanism does not employ any complex hydraulic or pneumatic system for achieving the required movement and adjustment and consequently it is suitable for use in small industrial plants and in areas where skilled maintenance personnel are not readily available.

In operation, the feeding mechanism is adjusted to provide a forward stroke upon each rotation of the main drive shaft equal to the required pitch between each successive corrugation to achieve the required arc of curvature in the channel-shaped sheet metal members. The smaller the radius of curvature, the closer the corrugations formed by the bending machine should be located. When the required pitch has been determined and the machine adjusted to achieve the required feeding stroke, a channel-shaped member is located on the conveyor forward run 102 and the machine is activated to move the channel-shaped member between the dies when in an open position. When the channel-shaped sheet metal member is located between the male and female dies, the first step in the bending operation is a clamping operation resulting from the movement of the male die member towards the female die in response to rotation of the cams 70 carried by the shaft 74. After the sheet metal member is clamped between the male die element 30 and the stationary first member 32 of the female die about the periphery of the passage 48, the eccentric collars 82 carried by the main drive shaft 80 are timed to raise the arms 84 and thereby raise the second die element 50 of the female die to drive the bending edge 52 upwardly through the passage 38 against the sheet metal member to deform it into the die cavities 54 and 56 formed in the die face of the male die element 34. Further rotation of shafts 74 and 80 causes the male die element 34 to be raised and the second member 50 of the female die element to be lowered.

During the bending operation, the eccentric collar 132 of the feeding mechanism has been operating to rotate the lever arm 128 of the ratchet mechanism in its non-indexing direction. However, when the dies begin to open, the lever arm 128 is drawn in its indexing direction and initially this causes the feeding chains 102 to be pulled to a taut condition causing the feeding run to rise out of the notches 46 in the female die, thereby raising the sheet metal member out of engagement with the die face of the female mould. Continued operation of the indexing mechanism causes the feeder chains 102 to advance the sheet metal member through the die to the required location for the next corrugation. Thereafter, the bending cycle of operation described above is repeated.

As shown in FIG. 7, the corrugated metal member is not corrugated at the longitudinal fold lines along the bottom wall 14. It will be understood that in order to shorten the bottom wall 14 by forming corrugations, it will be necessary to permit metal flow to occur at the edges of the bottom wall 14 so that there will be an increase in thickness in this area resulting from the corrugating operation. For this reason, the distance between adjacent corners of the first and second die faces is greater than the distance between the oppositely disposed bottom and side faces of the first die face and second die face when the dies are in the closed position.

It will be apparent that the bending machine of the present invention provides a simple and efficient mechanism for forming a longitudinal arc of curvature in an elongated channel-shaped sheet metal member by forming a plurality of transversely extending corrugations in the bottom and side walls of the sheet metal member.

I claim:

1. A bending machine for bending longitudinally elongated channel-shaped sheet metal members comprising, (a) a frame, (b) a die set mounted in said frame comprising;

(i) a female die assembly comprising, a first member having a first die face formed to provide a bottom face and side faces arranged in a female channel configuration to provide exterior support for a channel-shaped sheet metal member, a passage formed in said first member and opening at said die face through said bottom and side faces; and a second member mounted for movement relative to said first member and having a bending edge movable between an extended position in which it projects outwardly from said first die face through said passage and a withdrawn position in which it does not project beyond said first die face, (ii) a male die element having a second die face formed with bottom and side faces arranged opposite said bottom and side faces respectively of said female die, said male die element being mounted for movement towards and away from said first member of said female die assembly between an open position to permit movement of a sheet metal member therebetween and a closed position to clamp a channel-shaped sheet member there between about the periphery of said passage, (c) drive means for driving the male die element relative to the first member of the female die assembly to clamp a sheet metal member therebetween about the periphery of said passage and thereafter to drive the second member from said withdrawn position to said extended position to bend the bottom and side walls of the sheet metal to form a transversely extending corrugation in the sheet metal member and thereby shorten the bottom wall of the sheet metal member in relation to the outer ends of its side walls and thereby bend the sheet metal member in the direction of its longitudinal extent.

2. A bending machine for bending longitudinally elongated channel-shaped sheet metal members comprising;

(a) a frame, (b) a die set mounted in said frame comprising:

(i) a female die assembly comprising, a first member having a first die face formed to provide a bottom face and side faces arranged in a female channel configuration to provide exterior support for a channel-shaped sheet metal member, a passage formed in said first member and opening at said die face through said bottom and side faces; and a second member mounted for movement relative to said first member and having a bending edge movable between an extended position in which it projects outwardly from said first die face through said passage and a withdrawn position in which it does not project beyond said first die face, (ii) a male die element having a second die face formed with bottom and side faces arranged opposite said bottom and side faces respectively of said female die, said male die element being mounted for movement towards and away from said first member of said female die assembly between an open position to permit movement of a sheet metal member therebetween and a closed position to clamp a channel-shaped sheet member therebetween about the periphery of said passage, (c) drive means for driving the male die element relative to the first member of the female die assembly to clamp a sheet metal member therebetween about the periphery of said passage and thereafter to drive the second member from said withdrawn position to said extended position to bend the bottom and side walls of the sheet metal to form a transversely extending corrugation in the sheet metal member and thereby shorten the bottom wall of the sheet metal member in relation to the outer ends of its side walls and thereby bend the sheet metal member in the direction of its longitudinal extent, the bottom and side faces of said first die face meeting at corners at opposite sides of the bottom face and the bottom and side faces of the second die face meeting at corners at opposite sides of the bottom face thereof, and the distance between adjacent corners of said first and second die faces being greater than the distance between the oppositely disposed bottom and side faces of said first die face and said second die face when said first die member and said male die element are in said closed position thereby to permit an increase in thickness of the portion of the elongated channel-shaped member located at said corners during the formation of said transverse ridges and thus prevent buckling of the channel-shaped member.

3. A bending machine as claimed in claim 2 including feeder means for feeding elongated channel-shaped sheet metal members through said die set comprising, a pair of endless conveyor members arranged in spaced parallel relationship one at either side of said first member of said female die assembly, each endless conveyor member having a feeding run extending rearwardly and forwardly from said first member and through recesses in said first die face and feeder drive means for intermittently advancing said endless conveyor members to move a sheet metal member towards said die set.

4. A bending machine as claimed in claim 3 including guide means disposed forwardly and rearwardly from said die set for supporting said feeder run of said conveyor in a plane which is spaced outwardly from said first die face such that when said feeding run is taut for advancement of said sheet metal members, it will be raised from its recess in said first die face to elevate the sheet metal member from the first die face to permit it to move freely relative to said first die member, said feeding run having a sufficient length when relaxed to permit it to be lowered into its recess in said first die when said die set is in said closed position.

5. A bending machine for bending longitudinally elongated channel-shaped sheet metal members comprising;

(a) a frame, (b) a die set mounted in said frame comprising;

(i) a female die assembly comprising, a first member having a first die face formed to provide a bottom face and side faces arranged in a female channel configuration to provide exterior support for a channel-shaped sheet metal member, a passage formed in said first member and opening at said die face through said bottom and side faces; and a second member mounted for movement relative to said first member and having a bending edge movable between an extended position in which it projects outwardly from said first die face through said passage and a withdrawn position in which it does not project beyond said first die face, (ii) a male die element having a second die face formed with bottom and side faces arranged opposite said bottom and side faces respectively of said female die, said male die element being mounted for movement towards and away from said first member of said female die assembly between an open position to permit movement of a sheet metal member therebetween and a closed position to clamp a channel-shaped sheet member therebetween about the periphery of said passage, (c) drive means for driving the male die element relative to the first member of the female die assembly to clamp a sheet metal member therebetween about the periphery of said passage and thereafter to drive the second member from said withdrawn position to said extended position to bend the bottom and side walls of the sheet metal to form a transversely extending corrugation in the sheet metal member and thereby shorten the bottom wall of the sheet metal member in relation to the outer ends of its side walls and thereby bend the sheet metal member in the direction of its longitudinal extent, (d) feeder means for feeding elongated channel-shaped sheet metal members through said die set comprising, a pair of endless conveyor members arranged in spaced parallel relationship one at either side of said first member of said female die assembly, each endless conveyor member having a feeding run extending rearwardly and forwardly from said first member and through recesses in said first die face and feeder drive means for intermittently advancing said endless conveyor members to move a sheet metal member towards said die set, (e) guide means disposed forwardly and rearwardly from said die set for supporting said feeder run of said conveyor in a plane which is spaced outwardly from said first die face such that when said feeding run is taut for advancement of said sheet metal members, it will be raised from its recess in said first die face to elevate the sheet metal member from the first die face to permit it to move freely relative to said first die member, said feeding run having a sufficient length when relaxed to permit it to be lowered into its recess in said first die when said die set is in said closed position.

6. A bending machine as claimed in claim 5 wherein the bottom and side faces of said first die face meet at corners at opposite sides of the bottom face and the bottom and side faces of the second die face meet at corners at opposite sides of the bottom face thereof, and the distance between adjacent corners of said first and second die faces being greater than the distance between the oppositely disposed bottom and side faces of said first die face and said second die face when said first die member and said male die element are in said closed position thereby to permit an increase in thickness of the portion of the elongated channel-shaped member located at said corners during the formation of said transverse ridges and thus prevent buckling of the channel-shaped member.

* * * * *